US006846967B2

(12) United States Patent
Altersitz

(10) Patent No.: US 6,846,967 B2
(45) Date of Patent: Jan. 25, 2005

(54) NUCLEAR WASTE DISPOSAL SYSTEM

(76) Inventor: Larry A. Altersitz, 1205 N. Kings Hwy., Cherry Hill, NJ (US) 08034

( * ) Notice: Subject to any disclaimer, the term of this patent is extended or adjusted under 35 U.S.C. 154(b) by 340 days.

(21) Appl. No.: 10/036,199

(22) Filed: Jan. 4, 2002

(65) Prior Publication Data

US 2003/0130557 A1 Jul. 10, 2003

(51) Int. Cl.[7] ..... G21F 9/24
(52) U.S. Cl. ..... 588/17; 588/250; 405/129.1
(58) Field of Search ..... 588/17, 250, 249; 376/273, 274; 405/129.4, 129.45, 129.55, 129.6, 129.1

(56) References Cited

U.S. PATENT DOCUMENTS

| | | | | |
|---|---|---|---|---|
| 3,986,977 A | | 10/1976 | Gablin | |
| 4,178,109 A | | 12/1979 | Krutenat | |
| 4,196,169 A | | 4/1980 | Gablin et al. | |
| 4,307,679 A | | 12/1981 | Goldsberry et al. | |
| 4,738,564 A | | 4/1988 | Bottillo | |
| 4,855,082 A | * | 8/1989 | Duivelaar | 588/11 |
| 5,022,788 A | | 6/1991 | Baird | |
| 5,202,522 A | | 4/1993 | Williams | |
| 5,245,118 A | | 9/1993 | Cole, Jr. | |
| 5,354,355 A | | 10/1994 | Chapman | |
| 5,443,618 A | | 8/1995 | Chapman | |

FOREIGN PATENT DOCUMENTS

| | | | | |
|---|---|---|---|---|
| DE | 3109640 A1 | * | 9/1982 | G21F/09/24 |
| JP | 10078497 A | * | 3/1998 | G21F/09/00 |
| RU | 2001454 C1 | * | 10/1993 | G21F/09/24 |

OTHER PUBLICATIONS

Steven Nadis, "The Sub–Seabed Solution", Oct. 1996, The Atlantic Online, www.theatlantic.com/issues/96oct/seabed/seabed.htm.*

"Radioactive Waste", Integrated Environmental Management, Inc., 2001, http://www.iem–inc.com/prwaste.html.*

Parker, Sybil P, Encyclopedia of the Geological Sciences, 1987, McGraw–Hill, 6th Edition, p. 692.*

* cited by examiner

*Primary Examiner*—Stuart L. Hendrickson
*Assistant Examiner*—Peter J Lish
(74) *Attorney, Agent, or Firm*—Norman E. Lehrer

(57) ABSTRACT

A system for disposing of nuclear waste which essentially includes filling containers with nuclear waste and then dropping the containers into the sea in the path of an undersea volcano which is pouring lava onto the sea bed is disclosed. The containers are driven into the sea bed and will be covered by the lava.

4 Claims, 1 Drawing Sheet

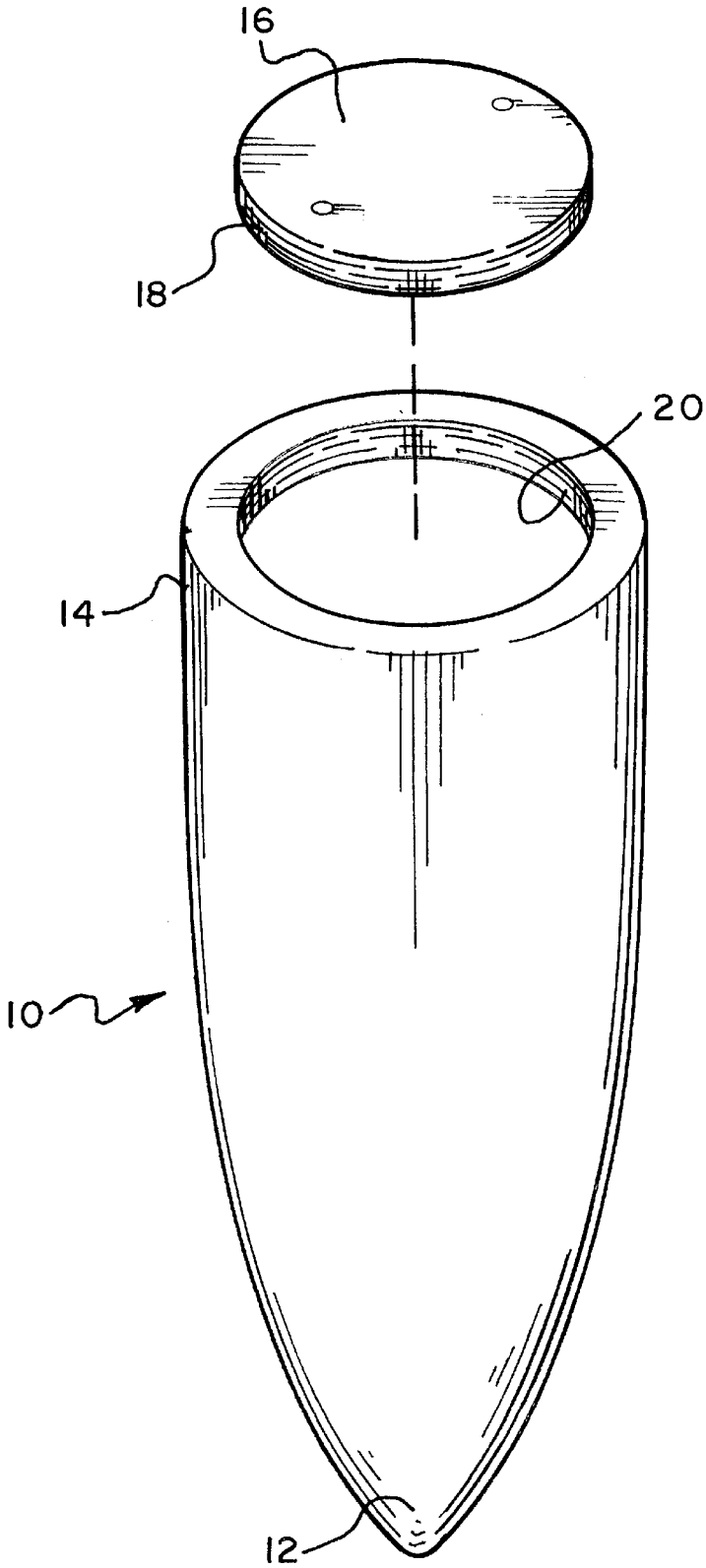
16
18
20
14
10
12

NUCLEAR WASTE DISPOSAL SYSTEM

BACKGROUND OF THE INVENTION

The present invention is directed toward a system for disposing of nuclear waste and more particularly, toward a system which essentially buries nuclear waste permanently under water and lava.

One of the problems facing the United States and much of the industrialized world is the need for a safe, permanent, and cost-effective method for disposing of nuclear waste. As a result, many solutions have been proposed for the problem of disposing of nuclear waste.

Typically, liquid radioactive waste is disposed of by burying the waste in the earth or at sea. To prevent contamination of the surrounding environment after burial, the liquid material is solidified in some manner so that it will remain buried and will not leak the radioactive materials. For example, U.S. Pat. No. 3,986,977 to Gablin discloses several methods for solidifying radioactive waste liquids into hardened masses suitable for disposal by burying the masses either in the earth or at sea.

U.S. Pat. No. 4,178,109 to Krutenat discloses disposing of nuclear waste by placing and sealing the waste in bore holes made in tectonic plates in the subduction zone and adjacent the nondescending earth crust where the tectonic plate and waste descend into the central region of the earth. However, the subduction rate at which a plate descends is only from about 0.5 to 9.5 centimeters per year. Therefore, it would take hundreds of years before the waste would be submerged.

U.S. Pat. No. 4,738,564 to Bottillo discloses a method of placing nuclear waste within containers and depositing the containers within active volcanoes containing molten lava so that the containers and waste sink into the lava and are dissolved therein, thereby diluting the waste to a harmless level. This method, however, leaves some uncertainty as to whether all of the waste is truly destroyed.

Therefore, a need exists for disposing of nuclear waste in an effective, safe, rapid, and permanent manner.

SUMMARY OF THE INVENTION

The present invention is designed to overcome the deficiencies of the prior art discussed above. It is an object of the present invention to provide a nuclear waste disposal system which essentially buries nuclear waste permanently.

It is another object of the present invention to provide a nuclear waste disposal system which includes disposal of all levels of waste in a safe and rapid manner.

It is a further object of the present invention to provide a nuclear waste disposal system which buries nuclear waste under water and lava.

In accordance with the illustrative embodiment demonstrating features and advantages of the present invention, there is provided a system for disposing of nuclear waste which essentially includes filling containers with nuclear waste and then dropping the containers into the sea in the path of an undersea volcano which is pouring lava onto the sea bed. The containers are driven into the sea bed by their weight and will be covered by the lava.

Other objects, features, and advantages of the invention will be readily apparent from the following detailed description of a preferred embodiment thereof.

BRIEF DESCRIPTION OF THE DRAWING

For the purpose of illustrating the invention, there is shown in the accompanying drawing one form which is presently preferred; it being understood that the invention is not intended to be limited to the precise arrangements and instrumentalities shown.

The sole FIGURE is a front perspective view shown essentially schematically of a container useful in carrying out the method of the present invention.

DETAILED DESCRIPTION OF THE PREFERRED EMBODIMENT

The system of the present invention essentially includes the steps of loading nuclear waste into a number of containers; mixing the waste with a molten substance; locating an undersea volcano where the volcano is pouring lava along the sea bed; and driving the containers into the sea bed and in the path of the lava.

The containers useful for practicing the invention may be of the type conventionally used for the safe containment of nuclear waste. For example, the containers may be made from steel, concrete, heat-resistant plastic, porcelain, lead, etc. Furthermore, empty nuclear reactors may be slightly modified and used as containers. The containers may be cylindrical and preferably have a sharp nose at a front end, a tapered body, and a rear end with a cap. When the containers are dropped into the water, the nose end should go in first. The weight and shape of the containers will drive them into the sea bed.

One example of a suitable container is shown diagramatically in the Figure and is designated generally at 10. The container 10 is preferably of substantially cylindrical shape having a pointed front end 12 and a rear end 14. Rear end 14 includes an end cap 16 which includes external threads 18 that are adapted to mate with corresponding internal threads 20 within the rear end 14 of the container 10.

In order to load the container 10, the cap 16 is removed and the container is placed into a vertical position. The radioactive waste is then loaded through the rear end 14. Preferably, the heavier materials are first loaded into the nose 12 followed by the lighter materials. In some cases, it may also be desirable to mix the radioactive waste with molten lead as it is placed into the container 10. This not only structurally stabilizes the nuclear waste and properly balances the container but it also provides a safe method of disposing of unwanted lead. Once the container 10 has been filled, the cap 16 is replaced and the rear end 14 is sealed by tightening the cap and preferably applying epoxy to the threads 18 and 20 on the final turn.

The container 10 can then be returned to a horizontal position for transport by ship to the desired site in the ocean where it can be dropped or jettisoned into the sea. Because of the shape, size and weight of the container 10, it will descend to the sea bottom and will drive itself into the sea bed where it will remain until it is covered by lava. This is accomplished by causing the container 10 to be dropped in front of the underwater moving flow of lava such as is occurring at the Kilauea Volcano in Hawaii.

As should be readily apparent to those skilled in the art, the invention may be used to dispose of substantially any type and level of waste, including weapons grade material. Although the Kilauea and Lo'ihi Volcanoes near Hawaii may be preferable sites, other underwater volcanoes around the world may also provide appropriate sites. Furthermore, if the lava flow is deemed inadequate high explosives may be used to increase the lava flow by breaking the volcano walls.

The present invention may be embodied in other specific forms without departing from the spirit and essential attributes thereof and accordingly, reference should be made to the appended claims rather than to the foregoing specification as indicating the scope of the invention.

I claim:

1. A method for disposing of nuclear waste comprising the steps of:

loading nuclear waste into a container;

locating an undersea volcano where the volcano is pouring lava along the sea bed;

placing said container onto the sea bed in the path of the lava, wherein said lava flows over said container.

2. The method for disposing of nuclear waste of claim 1 including the step of mixing said waste with a molten substance.

3. The method for disposing of nuclear waste of claim 2 wherein said molten substance is lead.

4. The method for disposing of nuclear waste of claim 1 wherein said container is made from steel.

* * * * *

UNITED STATES PATENT AND TRADEMARK OFFICE

CERTIFICATE OF CORRECTION

PATENT NO. : 6,846,967 B2
DATED : January 25, 2005
INVENTOR(S) : Larry A. Altersitz It is certified that error appears in the above-identified patent and that said Letters Patent is hereby corrected as shown below:

Title page,
Item [76], Inventor, should read -- Larry A. Altersitz, 305 Summit Avenue, Westville, NJ 08093-1029 --

Signed and Sealed this

Third Day of May, 2005

JON W. DUDAS
*Director of the United States Patent and Trademark Office*